US007736491B2

(12) United States Patent
Baptista et al.

(10) Patent No.: US 7,736,491 B2
(45) Date of Patent: Jun. 15, 2010

(54) PROCESS FOR THE FLUID CATALYTIC CRACKING OF MIXED FEEDSTOCKS OF HYDROCARBONS FROM DIFFERENT SOURCES

(75) Inventors: Claudia Maria de Lacerda Alvarenga Baptista, Rio de Janeiro (BR); Henrique Soares Cerqueira, Rio de Janeiro (BR); Emanuel Freire Sandes, Niteroi (BR)

(73) Assignee: Petroleo Brasileiro S.A. - Petrobras, Rio de Janeiro (BR)

( * ) Notice: Subject to any disclaimer, the term of this patent is extended or adjusted under 35 U.S.C. 154(b) by 763 days.

(21) Appl. No.: 10/559,528

(22) PCT Filed: May 19, 2004

(86) PCT No.: PCT/IB2004/002102

§ 371 (c)(1),
(2), (4) Date: Dec. 2, 2005

(87) PCT Pub. No.: WO2004/106466

PCT Pub. Date: Dec. 9, 2004

(65) Prior Publication Data

US 2006/0163116 A1 Jul. 27, 2006

(30) Foreign Application Priority Data

Jun. 3, 2003 (BR) ..... 0302326

(51) Int. Cl.

| | |
|---|---|
| ***C10G 11/00*** | (2006.01) |
| ***C10G 51/06*** | (2006.01) |
| ***C10G 35/04*** | (2006.01) |
| ***F27B 15/08*** | (2006.01) |
| ***B01J 8/08*** | (2006.01) |

(52) U.S. Cl. ..... 208/120.1; 208/113; 208/146; 208/147; 208/148; 208/149; 208/63; 208/64; 208/65; 208/66; 208/67; 208/70; 208/72; 208/73; 208/74; 208/75; 208/49; 208/76; 208/77; 208/78; 208/79; 208/80; 422/212; 422/214; 422/147; 422/139

(58) Field of Classification Search ..... 422/139, 422/147, 212, 214; 208/49, 63–67, 70–80, 208/81, 100, 103, 106, 113, 120.01, 120.15, 208/146–149

See application file for complete search history.

(56) References Cited

U.S. PATENT DOCUMENTS

| | | | | |
|---|---|---|---|---|
| 2,908,630 | A | 10/1959 | Friedman | |
| 3,246,960 | A | 4/1966 | Sharp et al. | |
| 3,617,497 | A | 11/1971 | Bryson et al. | |
| 3,894,932 | A * | 7/1975 | Owen | 208/74 |
| 4,218,306 | A * | 8/1980 | Gross et al. | 208/120.01 |
| 4,359,378 | A * | 11/1982 | Scott | 208/120.15 |
| 4,405,445 | A * | 9/1983 | Kovach et al. | 208/120.2 |
| 4,422,925 | A * | 12/1983 | Williams et al. | 208/75 |
| 4,764,268 | A | 8/1988 | Lane | |
| 4,818,372 | A | 4/1989 | Mauleon et al. | |
| 4,869,807 | A | 9/1989 | Krishna | |
| 4,929,337 | A * | 5/1990 | Herbst et al. | 208/120.01 |
| 4,985,133 | A | 1/1991 | Sapre | |
| 5,087,349 | A | 2/1992 | Goelzer et al. | |
| 5,098,554 | A * | 3/1992 | Krishna et al. | 208/113 |
| 5,154,818 | A * | 10/1992 | Harandi et al. | 208/74 |
| 5,264,115 | A * | 11/1993 | Mauleon et al. | 208/67 |
| 5,271,826 | A | 12/1993 | Krambeck et al. | |
| 5,326,465 | A * | 7/1994 | Yongqing et al. | 208/120.15 |
| 5,389,232 | A | 2/1995 | Adewuyi et al. | |
| 5,468,369 | A * | 11/1995 | Muldowney | 208/113 |
| 5,506,365 | A * | 4/1996 | Mauleon et al. | 585/329 |
| 5,616,237 | A | 4/1997 | Krishna et al. | |
| 5,846,403 | A * | 12/1998 | Swan et al. | 208/113 |
| 5,954,942 | A * | 9/1999 | Adornato et al. | 208/48 Q |
| RE36,403 | E * | 11/1999 | Krishna | 208/120.01 |
| 6,123,832 | A | 9/2000 | Ho et al. | |
| 6,296,812 | B1 * | 10/2001 | Gauthier et al. | 422/144 |
| 6,416,656 | B1 * | 7/2002 | Zhang et al. | 208/113 |
| 6,866,771 | B2 * | 3/2005 | Lomas et al. | 208/74 |
| 6,869,521 | B2 * | 3/2005 | Lomas | 208/67 |
| 2001/0035369 | A1 * | 11/2001 | Mon et al. | 208/74 |
| 2001/0040118 | A1 * | 11/2001 | Mon et al. | 208/74 |
| 2003/0196932 | A1 * | 10/2003 | Lomas | 208/67 |
| 2003/0196933 | A1 * | 10/2003 | Lomas et al. | 208/67 |

FOREIGN PATENT DOCUMENTS

| | | | |
|---|---|---|---|
| WO | WO8702695 | * | 5/1987 |
| WO | WO 93/22400 | | 11/1993 |
| WO | WO 01/00750 | A1 | 1/2001 |
| WO | WO 01/44406 | A1 | 6/2001 |

OTHER PUBLICATIONS

"Increase Gasoline Octane and Light Olefin Yield with ZSM-5", vol. 5, Issue 5—1999 Copyright Engelhard Corporation.*

* cited by examiner

*Primary Examiner*—Walter D Griffin
*Assistant Examiner*—Huy-Tram Nguyen
(74) *Attorney, Agent, or Firm*—Sughrue Mion, PLLC

(57) ABSTRACT

A process for the fluid catalytic cracking of mixed hydrocarbon feeds from different sources is described, such as feeds A and B of different crackability, the process being especially directed to obtaining light fractions such as LPG and comprising injecting feed A in the base of the riser reactive section and feed B, of lower crackability, at a height between 10% and 80% of the riser, with feed B comprising between 5% and 50% of the total processed feed. The process requires that the feeds present differences in the contaminant content, improved dispersion of feeds A and B and feed B injection temperature same or higher than that of feed A.

13 Claims, 2 Drawing Sheets

PROCESS FOR THE FLUID CATALYTIC CRACKING OF MIXED FEEDSTOCKS OF HYDROCARBONS FROM DIFFERENT SOURCES

FIELD OF THE INVENTION

The present invention relates to a process for the fluid catalytic cracking (FCC) of mixed feedstocks of hydrocarbons from different sources aiming at the maximization of light fractions such as LPG. More specifically, the present invention relates to a FCC process having improved yields for such mixed feedstock, where such improved yield is caused by the split-feed injection of the feedstocks from different sources aiming at favoring the operation conditions of the riser without altering the outlet temperature of same and at the same time not significantly altering the total catalyst circulation rate. The improved yield is associated to an increase in bottom conversion with an ensuing increase in the sum of valuable product yield, mainly LPG.

The split-feed injection involves the injection of one of the streams that make up the mixed hydrocarbon feedstock from different sources in at least one riser location placed downstream of the conventional injection under optimized conditions. The stream to be injected in the at least one location downstream of the riser should have significant differences in chemical properties related to the crackability of such stream relative to the feedstock to be injected in the lower reactive section of the riser. The stream to be injected in the at least one downstream location is produced by a thermal or a physical separation process, besides showing increased coke selectivity relative to the stream injected in the lower reactive section of the riser, is more refractory to cracking and has a higher contaminant content.

The injection of both feedstocks in the riser should occur with the aid of a plurality of high-efficiency oil feed-injection devices. The riser injection location for the lower crackability feedstock will be chosen according to the properties of the feeds to be cracked, aiming at obtaining the maximum possible LPG production, while at the same time keeping constant the riser outlet temperature.

BACKGROUND INFORMATION

Fluid catalytic cracking (FCC) is carried out by contacting hydrocarbons in a tubular reaction section or riser with a catalyst made up of a fine particulate material. The most common feedstocks to be submitted to a FCC process are usually those refinery streams from vacuum tower side cuts named heavy vacuum gasoils (HVGO) or heavier than the latter, from the bottom of atmospheric towers, named atmospheric residua (ATR), or still, admixtures of these streams.

These streams, having densities typically in the range of from 8° to 28° API, in order to deeply alter their composition and convert them to lighter, more valuable hydrocarbon streams, should be submitted to a chemical process such as the catalytic cracking process.

During the cracking reaction, substantial amounts of coke, as a reaction by-product, are deposited on the catalyst. Coke is a high molecular stock made up of hydrocarbons that contain of from 4 wt % to 9 wt % hydrogen in their composition.

The coke-recovered catalyst normally designed as "spent catalyst" is directed to the regenerator. In the regeneration zone, in a regenerator vessel kept at high temperature, coke deposited on the surface and in the catalyst pores is burned. Coke withdrawal by combustion leads to the catalyst activity recovery and releases heat in a sufficient amount to provide for the thermal requirement of the catalytic cracking reactions.

The fluidization of the catalyst particles by gaseous streams allows the catalyst transport between the reaction zone and the regeneration zone and vice-versa. The catalyst, besides doing its essential task of promoting the chemical reaction catalysis, is also the heat transport medium from the regenerator to the reaction zone.

The technique is abundant in descriptions of hydrocarbon cracking processes in a stream of fluidized catalyst, with catalyst transport between the reaction zone and the regeneration zone, and burning of coke in the regenerator.

In spite of the rather long existence of FCC processes, there is a continuous search for new techniques for improving the process, increasing the yield in more valuable products, such as gasoline and LPG. Broadly, it may be stated that the main objective of FCC processes is the maximization of said more valuable products.

The maximization of these products is basically obtained in two ways. One is the increase of the so-called "conversion", corresponding to the reduction in the production of heavy products such as clarified oil and light cycle oil. Another way is the reduction in the coke and fuel oil yields, that is, through the lower "selectivity" to these products.

The lower production of these two latter products, increasing the process selectivity to the target products, has as further beneficial results the need of smaller air blowers and wet gas compressors, those being big-sized, energy-consuming machines generally limiting of the UFCC capacity. Besides, it is economically interesting to promote the rise of more valuable products such as gasoline and LPG.

One important aspect to consider is the interest or need to increase LPG production according to the refiner's needs.

The experts know that an important feature of the FCC process is the initial contact of the catalyst and feed, this having a paramount influence on the conversion and selectivity of the process to generate valuable products. In a FCC process, the pre-heated hydrocarbon feed is injected near the bottom of a conversion zone or riser, where it contacts the flux of regenerated catalyst. It is from the regenerated catalyst that the feed receives heat in sufficient amount to vaporize and provide for the thermal demand of the endothermic reactions that predominate in the process.

After the riser, a long vertical tube having dimensions in an industrial unit of ca. 0.5 m to 2.0 m diameter by 25 m to 40 m height, where the chemical reactions occur, the spent catalyst, having coke deposited on its surface and pores, is separated from the reaction products. The spent catalyst is then directed to the regenerator to burn the coke in order to have its activity restored and generate the heat that, being transferred from the catalyst to the riser, will be used by the process.

The conditions existing in the feed injection location of the riser are determining as related to the products formed in the reaction. In this region the initial mixture of the feed and regenerated catalyst occurs, heating the feed until the boiling point of its constituents is attained with the vaporization of most of such constituents. The total residence time of the hydrocarbons in the riser is around 2 seconds.

In order to process the catalytic cracking reactions, it is required that the feed vaporization in the region of admixture with the catalyst occurs quickly so that the vaporized hydrocarbon molecules may contact the catalyst particles—the size of which is around 60 microns—permeating through the catalyst micropores and reacting in the acidic sites. Failure in achieving this quick vaporization results in the thermal cracking of the feed liquid fractions.

It is well known that thermal cracking favors the build up of by-products such as coke and fuel gas, mainly during the cracking of residual feeds. Coke poisons the acidic sites and may even block catalyst pores. Therefore, thermal cracking in the riser bottom undesirably competes with the catalytic cracking, object of the process.

The optimization of the feed conversion usually requires the maximum coke removal from the catalyst in the regenerator. Coke combustion may be obtained in a partial or total combustion regimen.

In the partial combustion regimen, the gases produced by coke combustion are mainly made up of $CO_2$, CO and $H_2O$ and the coke content in the regenerated catalyst is of the order of 0.1 wt % to 0.3 wt %. In the total combustion regimen, to be carried out in the presence of larger oxygen excess, practically all the CO produced in the reaction is converted to $CO_2$.

The oxidation reaction of CO to $CO_2$ is highly exothermic, making total combustion to occur with a large heat release, resulting in high regeneration temperatures. However, total combustion leads to a catalyst having less than 0.1 wt % and preferably, less than 0.05 wt % coke, this being a favorable feature relative to the partial combustion, besides avoiding the need of a costly boiler for further CO combustion.

The coke increase on the spent catalyst causes an increase of the coke burned in the regenerator by mass unit of the circulated catalyst. In conventional FCC units heat is removed from the regenerator in the combustion gas and mainly in the hot regenerated catalyst stream. An increase in the coke content on the spent catalyst increases the temperature of the regenerated catalyst as well as the temperature difference between the regenerator and the reactor.

Therefore a decrease in the regenerated catalyst flow rate to the reactor, normally designated as catalyst circulation rate, is required in order to attend to the reactor thermal demand and keep the same reaction temperature. However, the lower catalyst circulation rate required by the larger temperature difference between the regenerator and the reactor leads to a lower catalyst/oil ratio, this in turn reducing conversion.

Thus, catalyst circulation from the regenerator to the reactor is ascertained by the riser thermal demand as well as by the regenerator temperature, which is a function of coke production. Since the catalyst circulation itself affects coke produced in the riser, it is concluded that the catalytic cracking process works under a thermal balance regimen. In view of the preceding, operation at high regeneration temperatures is to be avoided.

Generally, on using modern FCC catalysts, regenerator temperatures and therefore regenerated catalyst temperatures are kept below 760° C., preferably below 732° C., since activity loss would be severe above this figure. A desirable operation range is of from 685° C. to 710° C. The lower limit is dictated mainly by the need to secure suitable coke combustion.

On processing increasingly heavy feeds, there is a tendency to increase coke production and the operation under total combustion requires the use of catalyst coolers to keep the regenerator temperature within acceptable limits. Generally, catalyst coolers remove heat from a regenerator catalyst stream, and return to said vessel a substantially cooled catalyst stream.

As for the fluid-dynamic features of the riser, where the catalytic cracking reactions of the invention occur, it is well known that catalyst solid particles are entrained in the reaction medium during contact with the feed and other vaporized materials.

This kind of reactor is normally of tubular shape where, in order to reduce by-products, operation should be carried out according to a hydrodynamic flow regimen, so that the superficial gas velocity is high enough to cause that catalyst flux is in the same direction as that of the feed and of other gases present therein. That is, the liquid and vaporized feed entrains the catalyst particles throughout the entire path in the tubular reactor.

These flow regimens are known by the experts as fast fluidized bed, riser regimen or more generally as transport regimen, those regimens being the preferred ones when one deals with reaction systems that require continuous flow reactors.

Generally, for a certain cross section area of a tubular reactor, which is a function of the reactor diameter, the catalyst concentration, in a fluidized bed reactor, is reduced as a result of increased superficial gas velocity. The higher the superficial gas velocity, the higher will be the reactor lengths required to allow that a certain amount of feed may contact the required amount of catalyst. Those higher superficial gas velocities require a higher L/D (Length/Diameter) ratio or aspect ratio of the reactor, which is the ratio between the reactor length and its diameter.

In the patent literature several publications suggest the multiple injection of the same feed in FCC units.

U.S. Pat. No. 3,246,960 teaches an FCC apparatus built so that the injection of the same feed in different locations of the riser is carried out so as to promote a more uniform mixture between feed and catalyst, with the consequent increase in gasoline octane rating.

International publication WO 0100750A1 teaches the recracking of naphtha to increase LPG yield, simultaneously with the split-feed injection of the same feed. The split-feed is injected in at least two different locations above the reactor lower position. The process aims at maximizing diesel oil production.

U.S. Pat. No. 4,869,807 teaches a process for converting a non-segregated hydrocarbon feed in a FCC reactor in the presence of a zeolitic catalyst for producing gasoline. The same feed is divided in portions and injected into a plurality of locations along the length of the FCC reactor, with of from 60 to 75% by volume being injected in the lowest injection position. The distance between this location and the immediately superior location comprises at least 20% of the total reactor length. Multiple injection would allow increased gasoline octane rating.

U.S. Pat. No. 5,616,237 teaches the same technique of multiple injection of the same feed in different locations to secure selectivity improvements. This approach reduces the contact time of the feed, with the consequent bottom conversion. It is also suggested to promote a recycle of the non converted friction to several injection locations along the riser length.

U.S. Pat. No. 6,416,656 discloses a process for catalytically cracking hydrocarbon stocks in a riser or fluidized bed reactor to increase simultaneously the yields of diesel and liquefied gas. The process includes the steps of: first, charging a gasoline stock and a catalytic cracking catalyst into a lower zone of the reactor to permit contact between the catalyst and the gasoline stock and to produce a liquefied gas-rich oil-gas mixture containing reacted catalyst. The resulting liquefied gas-rich oil-gas mixture (still containing reacted catalyst) is then introduced into a reaction zone above the lower zone of the reactor. Simultaneously, at least one conventional catalytic cracking hydrocarbon feed is also fed independently into at least two sites situated at different heights above the lower zone of the reactor. The resulting mixture is then separated in a conventional fashion.

Another approach from the patent literature involves injecting an auxiliary stream such as water or petroleum fractions in a location downstream of the injection of the feed to be cracked in order to promote an increase in the mixing temperature in the area of the feed injection. This is done aiming at increasing the vaporized percent of residual feeds, without altering the riser outlet temperature.

Such an approach is taught in U.S. Pat. No. 4,818,372 that relates to a FCC apparatus with temperature control including an upflow or downflow reactor, a device to introduce the hydrocarbon feed under pressure and in contact with a regenerated cracking catalyst. The FCC apparatus comprises further at least a device for injecting an auxiliary fluid downstream of the reactor zone where feed meets the catalyst, whereby it is desired to attain a higher temperature in the mixing zone of feed and catalyst. This document does not contemplate feed segregation, rather, it makes use of an inert, external fluid the main effect of which is the cooling of the injection region of said fluid, with temperature control and increase in catalyst circulation rate. In this respect please see Example 1, column 7, lines 55 to 60 of said patent, where it is defined that the feed is the same feed, injected once in the riser base while the other injection is effected with a cooling fluid as water or either a product of the cracking itself. The proposed process is directed to the cracking of a residual feed, the main feature of which is to contain at least 10% of a fraction having boiling point higher than 500° C. The desired goal when increasing the mixture temperature is to secure the vaporization of heavier fractions, while at the same time promoting a thermal shock on said fractions, aiming initially at converting the bigger molecules into lighter compounds, able to vaporize and catalytically cracking in a further step.

This is attained by injecting an auxiliary fluid above the feed injection location, from which the cracking reactions occur under milder conditions, at constant reaction temperature and independently of the desired mixing temperature.

The goal of the present invention is different and directed to the situation where feeds of different crackability are processed at the same time in one single riser. Under these conditions, it is suggested to inject the feed of lower crackability, the coke selectivity of which as well as the contaminant concentration is higher, in a riser downstream injection location. This aims at increasing the severity of the reactions of the feed of better quality injected in the beginning of the reactive section of the riser aiming mainly at higher LPG yields. This is obtained by a localized increase in the regenerated catalyst circulation as well as of the temperature of the riser section comprised between the two injections. Further, regenerated catalyst that contacts the better quality feed in the beginning of the riser reactive section is less deactivated by virtue of the local absence of contaminants as well as the higher coke production caused by the lower crackability feed.

The injection location of the feed of lower crackability in the riser is chosen so as to maximize LPG production, and is a function of the properties of the different feeds to be processed, as well as of the riser outlet reaction temperature.

A further distinguishing point between the present invention and U.S. Pat. No. 4,818,372 is that in this latter the total catalyst circulation is substantially increased. This may be observed from Example 1, in the Table of column 8, which sets forth an increase in the catalyst circulation rate from 4.6 to 6.7 by injecting a certain flow rate of water in the middle location of the riser. As a consequence, more coke will be formed, overloading the air blower of the regeneration section that normally is already very tight in terms of accepting any coke increase.

In the present invention, the resulting rise in catalyst circulation rate is only local, being limited to the section comprised between the lower and upper injections, but there is no significant increase in total catalyst circulation rate. Actually, as the lower crackability feed and normally having higher coke selectivity, is processed in the riser under milder temperature and contact time conditions, it is to be expected coke production to be slightly reduced.

Further, in the downstream injection location, the catalyst is recovered by a considerable content of deposited coke, this making it less selective to further coke formation. This way no overburden is expected on the air blower of the regeneration section, instead, a relief is to be expected.

A further disadvantage of the teachings of said U.S. Pat. No. 4,818,372 is the overburden of the riser, reactor cyclones, transfer line, main fractionator as well as of the top condensers of the fractioning section at the moment of the injection of make up water in the riser. This leads to adapt the dimensioning of most of the equipment to the requirement of the claimed process.

Besides, injecting water in the riser means a poor energetic balance of the FCC process, since all the energy that water removes from the converter is lost when the same water condenses on the top of the main fractionator coolers. It should also be mentioned the further disadvantage of additional acidic water generation in the refinery.

As taught in U.S. Pat. No. 4,818,372, the segregated injection of an external stream in a downstream riser location is carried out aiming at controlling the riser temperature profile. This makes possible to keep the upstream section of the riser at a relatively higher temperature without altering the riser top temperature or TRX (reaction temperature). Such control may also be carried out through a heavy naphtha recycle, as taught in U.S. Pat. No. 5,087,349.

Aiming at the same goal, U.S. Pat. No. 5,389,232 teaches a heavy naphtha recycle in downstream riser locations.

Aiming at minimizing naphtha overcracking reactions, U.S. Pat. No. 4,764,268 suggests the injection of a LCO stream in the top of the riser.

A similar alternative, taught in U.S. Pat. No. 5,954,942 aims at increasing conversion, through a quench or quick cooling with the aid of a steam auxiliary stream in the riser upper region.

International publication WO 93/22400 mentions the possibility of injecting along the riser a cracking product such as LCO aiming at cooling the riser and consequently promoting an increase in the catalyst circulation rate so as to make possible improved performance of ZSM-5 additives.

Contrary to U.S. Pat. Nos. 4,818,372, 4,764,268, 5,389,232, 5,954,942 and International publication WO 93/22400, in the present invention the feed injected in the one or more downstream riser locations is not an auxiliary external stream but rather one of the streams that normally make up the feed of the FCC unit. Since the segregated feed is injected at a temperature equal or higher than the feed temperature, the improved yields should not be considered as caused by an increase in the total catalyst circulation rate.

As regards the injection of the segregated feed in different locations of the riser, some publications suggest to differentiate feeds as a function of the nitrogen content only.

Thus, U.S. Pat. No. 4,985,133, aiming at reducing $NO_x$ release into the regenerator, teaches an alternative for the injection of the higher total nitrogen feed in the riser base, the less contaminated feed being injected in a higher nozzle.

U.S. Pat. No. 4,218,306 teaches a FCC process for producing gasoline and distillate by combining cracking of a distillation gasoil injected in the base of a cracking zone of a riser for admixture with a regenerated catalyst to form a catalyst suspension at high temperature. A second hydrocarbon fraction having more difficult cracking features is charged at a location 3.05 m to 9.14 m (10 to 30 feet) downstream the first injection. The riser outlet temperature is limited to the range between 482° C.-593° C. (900° F. to 1100° F.), preferably 510° C.-530° C. (950° F. to 985° F.).

Said U.S. Pat. No. 4,218,306 is directed to improved gasoline yields, as set forth in the main claim. In a patentably distinguishing way, the present invention is a much more flexible process, directed to either LPG only or to the sum LPG+gasoline, according to the injection location of the feeds in the riser as well as the desired riser outlet temperature. Besides, contrary to the teachings of said US patent, according to the invention, the injection of the lower crackability feed is not limited to the riser section placed 10 to 30 feet (corresponding to 6% to 30% of the reactive section of a typical industrial riser) downstream of the riser base injection of the better crackability feed.

In the present invention the injection location of the lower crackability feed is set forth aiming at obtaining the maximum possible LPG yield. Such location is a function of the properties of the feeds of different sources to be processed, of the percent of the lower crackability feed processed based on the total feed flow rate as well as of the riser outlet reaction temperature. Said injection location may be positioned at any location downstream the injection of the lower feed, but preferably of from 10% to 80% of the riser reactive section. As a general rule, the ideal location for injecting the lower crackability feed is that, which provides for the operation conditions favoring the maximization of LPG production in the section between the two feed injections. Further, said location should conform to the minimum residence time required by the lower crackability feed to undergo the desired conversion to lighter products, including LPG.

It should be noted that in column 4, line 3 of U.S. Pat. No. 4,218,306, it is stressed that the downstream injection should be submitted to very slight or no heating at all, this featuring a feed cooling or quenching, such cooling being completely absent from the inventive process. Therefore, the concept of the said US patent, as applied to the main objective of the present invention, that is, maximum LPG production would not lead to the desired results.

U.S. Pat. No. 6,123,832 teaches a FCC process for the conversion of hydrocarbon mixtures based on a non-linear phenomenon consisting in the fact that the lower yield in valuable products is not linearly reduced, neither the coke yield increases linearly, with the increase in heavy component in the FCC feed.

This means that the marginal deleterious effect caused by feed contaminants on the FCC catalyst is weaker with the increase in heavy components. Alpha and beta different quality feeds are to be injected in different nozzles. Alternatively, different nozzles may be used. Still alternatively, the riser is divided in two zones for separate cracking in one portion of the riser. Thus, the benefit of using at least one high CCR feed stems from the fact that the lower CCR feed increases conversion to a much higher degree than the conversion loss due to the higher CCR content feed.

The conditions for differentiating alpha- and beta-feeds are: a) the CCR figures differ from at least 2 points in wt %; or b) they differ in hydrogen content by at least 0.2 wt %; or c) they differ in API gravity by at least two points; or d) they differ in nitrogen content by at least 50 ppm; or e) they differ in the C/H ratio by at least 0.3; or f) they differ in average boiling point by at least 93.3° C. (200° F.). The technique taught in said US patent is not clear as regards which feed is to be injected in which nozzle or riser position, or in which riser. One claim is directed to the methodology for calculating possible feed mixtures that could lead to desirable results in terms of valuable products. Injection is non-linear (claim 2, column 9).

Another alternative is the injection of an external stream such as an alcohol, ether or a gasoil of better quality than the feed injected in the riser base, as taught in U.S. Pat. No. 5,271,826. This approach does not contemplate feed segregation according to the concept of the invention.

Another approach for feed segregation, as taught in U.S. Pat. No. 4,422,925 and U.S. Pat. No. 3,617,497 is based on the difference between feeds exclusively focused on molecular weight, while suggesting multiple injections in the riser. The lower molecular weight feed is injected in the riser base aiming at maximizing gasoline yields. However, as will be seen hereinafter in the present specification, a single parameter for differentiating feeds is not sufficient for obtaining the desired results in terms of yields and products.

On the other hand, it is well known that the density is closely associated to the extent of feed contamination, as reported on page 132 of the article by M. A. Torem et al., in "Development of a new coefficient to predict FCC feedstock cracking", ACS 206th National Meeting—Advances in Fluid Catalytic Cracking—1993, Chicago, USA.

The considerations set forth above indicate that, in spite of the extended literature and patent publications, there is no description nor suggestion, In isolated or combined way, of a FCC process free of overall sensible cooling effect and without significant alteration of the total catalyst circulation rate, having improved conversion to light products such as LPG and gasoline, this being obtained from a mixed A and B hydrocarbon feed where feed B is produced by a thermal process or by physical separation, is more selective to coke formation relative to the feed to be injected in the base of the riser reactive section, is more refractory to cracking and is more heavily contaminated, where the conditions for injecting the segregated feed involve suitable distances between the injection locations in the riser and optimized dispersion of both feeds A and B aiming at maximizing LPG production, such process being described and claimed in the present application.

SUMMARY OF THE INVENTION

Broadly, the process of the invention for the fluid catalytic cracking of mixed A and B feeds of hydrocarbons of different sources in a riser reactor in the presence of a zeolite catalyst under cracking conditions and in the absence of added hydrogen, for obtaining mainly light products such as LPG, feed B being more refractory to cracking, comprises the segregated injection of such A and B feeds in distinct riser locations, and wherein:

a) feed B is in an amount of from 5% and 50% by mass based on the total processed feed;

b) the injection location of feed A sets the base of the riser reactive section;

c) feed B is injected in one or more riser locations downstream the injection location of feed A and shows, in combination:

i) higher coke selectivity relative to feed A; and ii) higher contaminant content, and where the injection conditions of feed B involve:

i) injection location between 10% and 80% of the total length of the riser reactive section;

ii) improved dispersion; and iii) same or higher injection temperature based on the injection temperature of feed A, said process resulting in recovering LPG in a higher amount than would be possible if feeds A and B were injected both in the base of the riser reactive section.

Thus the present invention provides a FCC process for the cracking of mixed hydrocarbon feeds of different crackability having increased conversion to valuable products such as the sum of LPG and gasoline resulting from modifying the riser temperature profile.

The present invention provides further a FCC process for the cracking of mixed hydrocarbon feeds of different crackability where the modification of the riser temperature profile is obtained from the injection of a less crackable feed under optimized temperature and dispersion conditions, at a length of from 10% to 80% of the base of the riser reactive section.

DETAILED DESCRIPTION OF THE INVENTION

Figure 1:
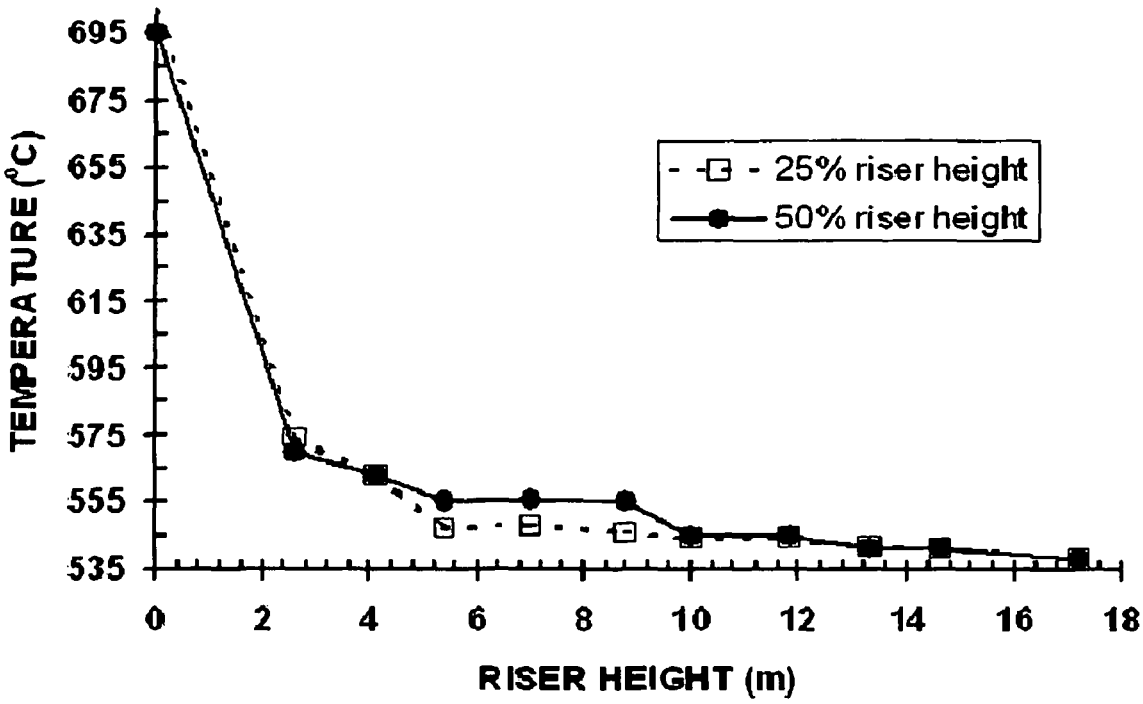
FIG. 1 attached is a graph of the temperature profile of a FCC riser where the mixed hydrocarbon feed A and B is cracked according to the invention. Illustrated are locations that represent respectively the injection of feed B at 25% of the riser reactive section and 50% of the riser reactive section.

The present invention relates therefore to a FCC process for the conversion of mixed hydrocarbon feeds of different sources having high yields in valuable products, mainly LPG, the increased conversion resulting from the segregated injection of the different feeds to be processed according to the crackability features as well as from the presence of contaminants in each feed.

The invention is applicable to FCC units specially directed to the processing of mixed feeds from different refining processes, for example, the straight-run distillation gasoil and more refractory feeds, from thermal processes or physical separation.

One aspect of the invention is therefore a FCC process for the conversion of mixed hydrocarbon feeds where the improved process profitability results from the injection of each of the feeds in different riser locations.

The process may be applied to FCC units that comprise tubular riser reactors as well as those that comprise downflow reactors.

The catalyst used in the performance of the inventive process is preferably a catalyst that comprises a high activity cracking crystalline zeolite as well as a fluidizable particle size. A preferred catalyst comprises a Y zeolite. Another preferred catalyst comprises a ZSM-5 zeolite. Still useful for the purposes of the invention is the combined use of catalysts that comprise said Y and ZSM-5 zeolites, in any amount. As is known by the experts, this zeolite class favors the LPG production. The zeolite or zeolites may be present also as additives.

As a general rule, the residence time for the contact of the hydrocarbon feed with the catalyst is in the range of from 0.5 to 10 seconds or more, preferably, of from 1 to 2 seconds.

And the residence time of feed A in the riser submitted to the cracking catalytic reactions, measured between feed A and feed B injections, is in the range of from 0.5 and 2 seconds.

The catalyst/oil ratios are between 2/1 to 15/1, preferably of from 6/1 to 8/1.

Residence times are determined so that feed A is allowed longer contact time with the catalyst suspension and a huge amount of gasoline and LPG is obtained, mainly LPG, while at the same time the required period for the cracking of B feed is obeyed. Imparting a high dispersion degree to feed B may reduce such period of time.

As in typical catalytic cracking processes, the present process involves the contact of the hydrocarbon feed with a solid particulate catalyst in a reaction zone under conditions such that the hydrocarbon feed is converted into desired, lower molecular products accompanied by the production of hydrogen and other gaseous products and coke deposition on the surface of the catalyst particles. Such systems comprise a transport zone, through which cross vaporized hydrocarbons and solid catalyst suspended in or carried by hydrocarbon vapors, optionally combined with steam.

Reaction products and catalyst are discharged from the transport zone to a separation zone in which hydrocarbon vapors are separated from catalyst.

Due to coke deposition on the catalyst surface the catalyst is partially deactivated during the passage through the reaction zone. The partially deactivated catalyst is designed as spent catalyst in opposition to the regenerated catalyst. Spent catalyst is regenerated by combustion of coke deposits on its surface by means of an oxygenated gas.

Regeneration of spent cracking catalyst is carried out after the separation of spent catalyst from reaction products discharged from the reaction zone. At first spent catalyst is made to contact in a stripping zone, a stripping medium, normally steam, to withdraw vaporizable entrained and occluded hydrocarbons from the catalyst.

From the stripping zone, the stripped catalyst is directed to a regeneration zone where the stripped spent catalyst is regenerated by burning coke deposits on same with the aid of an oxygenated gas, normally air.

The hot regenerated catalyst resulting from the regeneration zone is then recycled to the reaction zone to be contacted with a further hydrocarbon feed.

The inventive process results in increased profits for FCC units that process mixed feeds.

For a feed or mixed stream generally designed as feed A and feed B, feed A is a gasoil-type feed, having more favorable crackability features, such as a vacuum distillation heavy gasoil (HVGO).

And feed B is a stream normally produced from a thermal or physical separation process, such as for example thermal cracking, pyrolysis, delayed coking, shale oil retorting, etc. Generally, feed B contains a high degree of total nitrogen, basic nitrogen and/or sulfur compounds. Polynuclear aromatic compounds may equally be present, therefore having a trend to form coke, besides metal contaminants such as nickel, harmful to the cracking catalysts.

Feed B may be a single stream or be a mixture of streams from thermal or physical separation processes.

The stream or mixture of streams from thermal or physical separation processes, normally more refractory to cracking than the vacuum distillation gasoil (HVGO)—the usual FCC unit feed—is injected in one or more locations downstream the main injection directed to the base of the riser reactive section, such locations being placed between 10% and 80% of the riser height.

Alternatively, the injection of feed B is effected in more than one riser downstream location, as desired by the refiner. Still alternatively, different B and C feeds may be injected in different downstream riser locations.

The amount of feed B relative to feed A varies between 5% and 50% mass based on the total processed feed.

The injection of feed B in a location downstream of feed A injection provides to said feed localized conditions of catalytic cracking that are more severe as regards temperature and catalyst circulation, while at the same time the regenerated catalyst deactivation caused by coke or contaminants is minimized.

The combination of the above conditions leads to the maximization of LPG production from feed A, without significantly increasing the total catalyst circulation nor altering the outlet riser reaction temperature. As a consequence, there are no restrictions to the regeneration section air blower, nor are there restrictions regarding the metallurgical limit of the equipment that are downstream of the riser.

On the other hand, the injection location of feed B should be such that, at the same time that it maximizes LPG production from feed A, it provides reaction conditions (temperature and residence time) sufficient for obtaining an acceptable LPG yield from the cracking of feed B itself. Thus, the ideal injection location for injecting feed B depends on the properties of feeds A and B, on the percentage of feed B relative to the total processed feed and on the riser outlet reaction temperature.

As for the system for controlling the injection of feed B in the riser, such system can be completely independent from the variables of the FCC converter.

Alternatively, the control system may be set as a function of the desired mixing temperature in the contact region of feed A with the regenerated catalyst.

Still alternatively, the control system is set as a function of the obtained LPG yield.

Still alternatively, the control system is a function of any other variable that it is desired to control, any known control logic being used for such purpose.

The temperature rise in the mixing region between feed A and the regenerated catalyst is of from 10° C. to 50° C., this being provided for by injecting feed B at a riser location above the injection of feed A. Such temperature is in the range of from 520° C. to 650° C.

The maximum temperature of feed B is limited to 430° C.

Broadly, it is possible to state that, aiming at obtaining maximum LPG yield, the following assumptions hold:

i) the lower the crackability of feed B, the longer the period of time required for it to obtain acceptable conversion levels;

ii) the higher the percentage of feed B relative to the total processed feed, the higher the severity required for the cracking of feed A;

iii) the farther the injection location of feed B relative to the injection of feed A, the longer the period of time during which feed A will be submitted to the more severe cracking conditions that favor LPG yields;

iv) the higher the riser outlet reaction temperature, the higher will be the temperature at which feed A will be submitted to catalytic cracking.

Usually, temperature increase is accompanied by higher gasoline and LPG yields. However, from a certain temperature, normally situated between 540° C. and 560° C., depending on the residence time, gasoline overcracks to LPG, with a substantial increase in LPG yield at the expense of the gasoline amount to be obtained.

Figure 2:
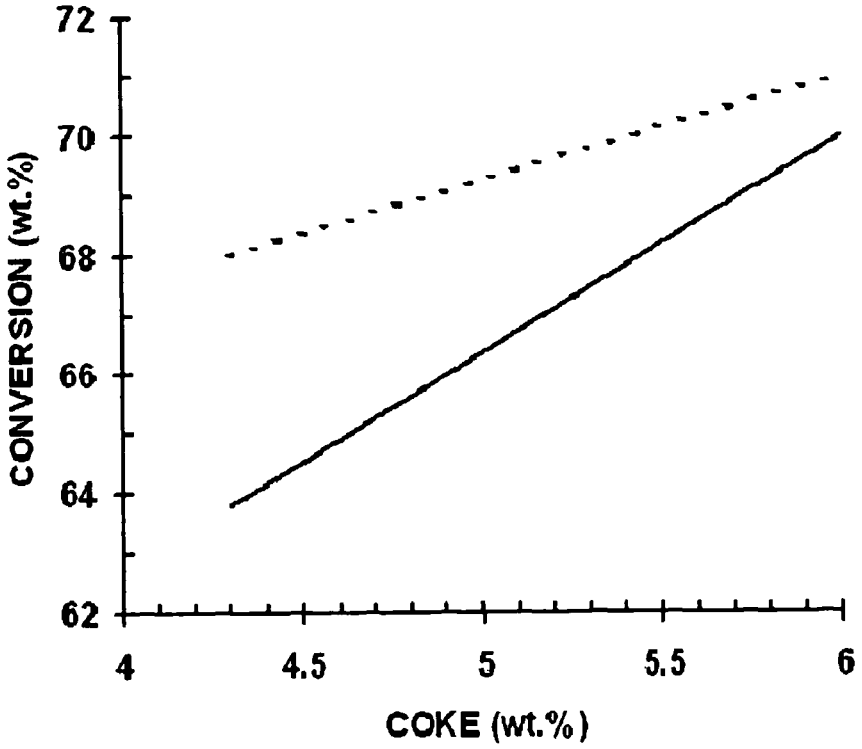
FIG. 2 attached is a graph of conversion vs. coke, where the full line stands for the base case and the dotted line, for the invention.

FIG. 2 illustrates the LPG rise obtained as compared to the base case. Data for FIG. 2 were obtained by injecting feed B in an amount of 15 wt % based on the total processed feed. Feed B was injected at a location 25% of the riser reactive section, the injection temperature being 80° C. higher than the injection temperature of feed A.

Figure 3:
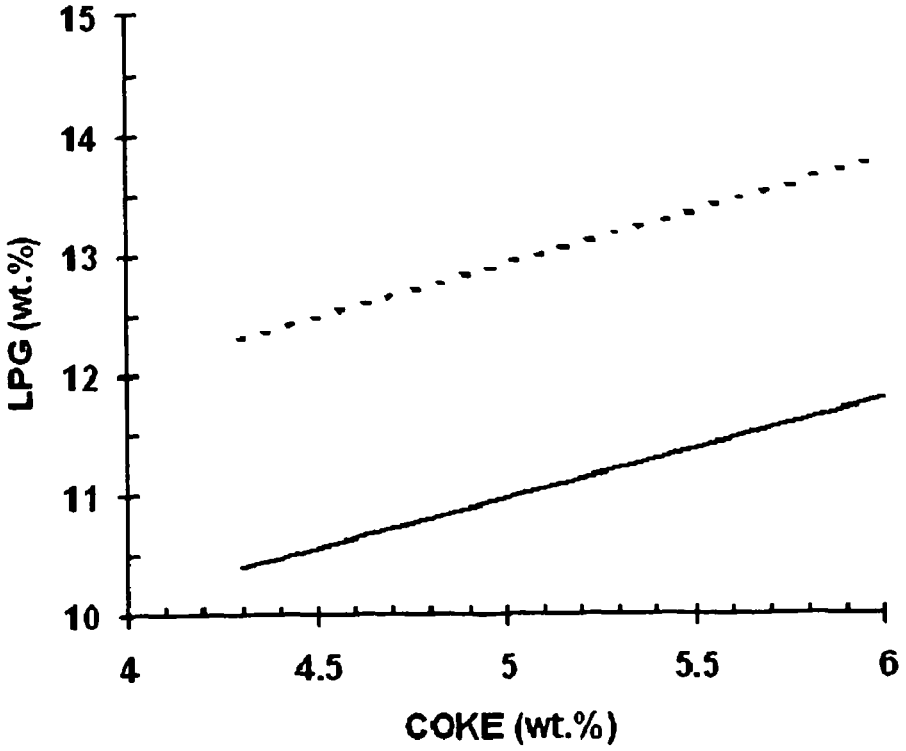
FIG. 3 attached is a graph of LPG vs coke, where the full line stands for the base case and the dotted line, for the invention.

FIG. 3 illustrates, for the same experimental conditions used in FIG. 2, the conversion rise obtained by applying the inventive process.

The higher the severity required for the catalytic cracking of feed A, that is, the higher the cracking temperature, the residence time and the local circulation of regenerated catalyst, the higher will be the LPG yield obtained from feed A.

According to the invention, the riser outlet reaction temperature is in the range of from 520° C. to 590° C.

Besides the maximization of valuable products, the catalytic path, as stressed by the present invention, provides a gasoline product not only of octane rating similar to that of the base case, but also of stable quality. Specifically as concerns the quality, it is essential that feed B presents the required cracking conditions, aiming at securing that gasoline and LCO products do not contain contaminants above the accepted levels. There should be enough reaction time for the cracking of feed B, so as to secure that most of the contaminants present in said feed are conveyed to the coke formed on the spent catalyst, instead of being released together with the cracking products. This is an additional concern that should be considered in defining the injection location of feed B in the riser. Broadly, such location should not surpass 80% of the riser reactive section.

In order to obtain the desired results from the process, feed A as well as feed B injected in the one or more downstream locations in the riser should be submitted to optimized atomization (dispersion) conditions. Such conditions involve, for example, the use of high-efficiency feed-dispersion devices, besides an optimum dispersing fluid/oil ratio, injection temperature or a combination of these conditions.

A high-efficiency feed-dispersion device useful in the inventive process is that one taught in International Application WO 0144406, of the Applicant. However, other commercial feed-dispersion devices can be used, provided they provide optimized conditions for the feed that is to be dispersed.

The concept of the present invention comprises a temperature rise in the riser section situated between the injection location of feed A in the base of the riser reactive section and the downstream injection location of feed B in the riser. As a consequence, there is a high conversion level for feed A that favors the total yield of LPG and gasoline by weight.

This is because, contrary to the base case where feeds A and B are cracked in admixture, the initial cracking of feed A separately and at least 5% by weight of feed B injected in one or more downstream riser locations cause a temperature rise as well as a higher local catalyst circulation in the riser section situated between the conventional injection location and the injection location(s) of feed B.

In the next section, situated between the downstream injection location and the riser top, more refractory feed B from a thermal or physical separation process undergoes thermal and catalytic cracking reactions. Since coked catalyst is less coke sensitive, these reactions occur without significant increase in the coke content deposited on the catalyst.

The position of one or more downstream locations in the riser should be selected so that the reduced contact time can be partially compensated by optimizing the atomization condition of feed B from thermal or physical separation process.

It should be understood that, contrary to what is taught in state-of-the-art documents, in the present invention the feed portion injected in the one or more downstream locations relative to the riser base does not aim at promoting a quenching, neither controlling the temperature of the location downstream the injection location.

Besides, the benefits attained by applying the teachings of the present invention are not related to a catalyst circulation rate increase, since the segregated fraction is not an external stream. This makes possible that such stream may assume temperature levels that are the same or different from those of the feed injected in the base of the riser reactive section, as will be discussed in one of the Examples hereinbelow.

In the present invention, the more refractory stream, from thermal or physical separation process, feed B, should always be injected in one of the downstream locations, while feed A of better crackability should be injected in a location in the base of the riser reactive section. This procedure allows that feed A of better crackability contacts a more active, less contaminated catalyst suspension in the section situated between the base of the riser reactive section and the segregated injection of feed B, attaining increased conversion of such feed A.

The fraction of feed B from thermal or physical separation process based on the total processed feed should be of from 5% to 50% by mass, preferably of from 15% to 25% by mass.

The injection of feeds A and B of different origins in the base of the riser reactive section and in the riser downstream location should be simultaneous.

Still, the best profitability of the inventive FCC process results from a combination of conditions, and not only from one or another isolated condition, as taught in some state-of-the-art publications.

Thus, Research carried out by the Applicant has indicated that feed B to be injected in one or more downstream riser location should have a higher basic nitrogen and contaminant content, besides specific injection temperature conditions as well as optimized dispersion. As cited hereinbefore, U.S. Pat. No. 4,985,133 teaches a single criterium for making the difference between the feeds, that is, the higher nitrogen content of the feed to be injected in the base of the riser reactive section. On the other hand, U.S. Pat. No. 4,422,925 teaches to make the difference between feeds by the molecular weight only.

The invention will now be illustrated by the following Examples, which should not be construed as limiting it.

EXAMPLES

Aiming at effectively demonstrating the efficacy of the invention, a series of tests were run in a multipurpose FCC unit owned by the Applicant, such unit having an output of nearly 200 kg/h feed.

The feed characterization is listed in Table 1 below.

Feed A is a direct distillation vacuum gasoil (HVGO) while feed B is a heavy gasoil from a delayed coking unit.

TABLE 1

| Properties | Feed A | Feed B |
|---|---|---|
| Density @ 20/4° C. (g.cm$^{-3}$) | 0.9410 | 0.9486 |
| Viscosity (cSt) @ 82.2° C. | 132.5 | 61.4 |
| Total S (ppm) | 6,400 | 5,385 |
| Total N (ppm) | 2,880 | 5,222 |
| Flash point, ° C. | 168 | 114 |

Example 1

Example 1 shows the effect of the injection location. Collected data, listed in Tables 2A and 2B below, evidence the conversion rise to valuable products by segregating feed B to a location downstream to the conventional feed injection. Case 1 is the base case, where the feeds are injected in admixture in the base of the riser reactive section, in the amount of 85% heavy vacuum gasoil (HVGO), feed A, and 15% of coke heavy gasoil (KHGO), feed B. Reaction temperature level (TRX) is 540° C. for all tests.

According to cases 2 and 3 of Tables 2A and 2B, which illustrate the concept of the invention, the downstream injection location favors gasoline overcracking, since a rise in LPG is observed at the expense of gasoline. This difference is explained by the change in the temperature profile throughout the riser, as illustrated in FIG. 1.

TABLE 2A

| | Feed A | Feed B | | | | |
|---|---|---|---|---|---|---|
| Case | Riser Base (%) | Riser Base" (%) | 25% Riser (%) | 50% Riser (%) | Temp. (° C.) | Dispersion steam (%) |
| 1 | 85 | 15 | — | — | 220 | — |
| 2 | 85 | — | 15 | — | 220 | 10 |
| 3 | 85 | — | — | 15 | 220 | 10 |

TABLE 2B

| | | Yields | | | | | | |
|---|---|---|---|---|---|---|---|---|
| Case | CTO | Conv, (%) | FG (%) | LPG (%) | GLN (%) | LCO (%) | DO (%) | Coke (%) |
| 1 | 6.5 | 66.8 | 2.8 | 10.7 | 48.3 | 17.0 | 16.2 | 5.0 |
| 2 | 6.6 | 67.8 | 3.0 | 12.5 | 47.3 | 17.2 | 15.0 | 5.1 |
| 3 | 6.4 | 68.4 | 3.2 | 14.1 | 45.9 | 16.5 | 15.0 | 5.2 |

Where: CTO = Catalyst To Oil ratio"
FG = Fuel Gas
GLN = Gasoline
LCO = Light Cycle Oil
DO = Deasphalted Oil
LPG = Liquefied Petroleum Gas Therefore, data indicate a rise in LPG production consequent to i) the increase in the distance of the downstream injection location relative to the injection location in the base of the riser reactive section and ii) the use of dispersion steam to optimize the dispersion of the feed of lower crackability.

As indicated in the corresponding column of Table 2B, the catalyst to oil ratio CTO practically does not vary, this being a patentably distinguishing feature of the present invention.

FIG. 1 is a plot of the temperature profile along the riser. This plot illustrates the fact that when the segregated injection is effected in a downward location, a larger section of the riser operates at higher temperatures, which entails a conversion rise for feed A.

Example 2

Data for Example 2, listed in Tables 3A and 3B below, evidence the relevance of optimizing the dispersion conditions of the downward injection location.

In all cases, reaction temperature level was 540° C. Data show that an increase in dispersion steam from 5% to 20% as well as a temperature rise cause better dispersion with a consequent conversion increase. The higher the oil temperature, the lower its viscosity, and consequently the lower the diameters of the formed droplets in the atomization process. As a consequence, the more intimate is the contact of oil and catalyst, which accelerates oil vaporization, the higher the effect of minimizing thermal cracking reactions, so as to intensify the catalytic route. Depending to the quality of feed B, according to the one used in Example 2, a temperature rise applied to such feed can be conclusive for the improvement in the distribution of obtained yields.

Thus, case 7 evidences that in the present invention the benefits are obtained not as a function of a quenching with the consequent increase in catalyst circulation rate, since the catalyst to oil ratio did not vary beyond 0.5 in the studied cases.

TABLE 3 A

| | Feed A | Feed B | | | | |
|---|---|---|---|---|---|---|
| Case | base Riser (%) | Base Riser (%) | 25% Riser (%) | 50% Riser (%) | Temp. (° C.) | Dispersion steam (%) |
| 4 | 85 | — | 15 | — | 220 | 5 |
| 5 | 85 | — | 15 | — | 220 | 10 |
| 6 | 85 | — | 15 | — | 220 | 20 |
| 7 | 85 | — | 15 | — | 300 | 10 |

TABLE 3B

| | | Yields | | | | | | |
|---|---|---|---|---|---|---|---|---|
| Case | CTO | Conv. (%) | FG (%) | LPG (%) | GLN (%) | LCO (%) | DO (%) | Coke (%) |
| 4 | 6.3 | 67.9 | 3.0 | 11.9 | 48.1 | 16.6 | 15.5 | 4.9 |
| 5 | 6.6 | 67.8 | 3.0 | 12.5 | 47.3 | 17.2 | 15.0 | 5.1 |
| 6 | 6.8 | 68.4 | 3.0 | 12.5 | 47.7 | 17.1 | 14.6 | 5.2 |
| 7 | 6.3 | 69.6 | 2.8 | 13.5 | 47.8 | 16.7 | 13.7 | 5.4 |

Where: CTO = Catalyst To Oil ratio"
FG = Fuel Gas
GLN = Gasoline
LCO = Light Cycle Oil
DO = Deasphalted Oil
LPG = Liquefied Petroleum Gas

Example 3

Example 3 illustrates the effect of partial segregation of one of the feeds, showing that the process of the invention is not applicable when in spite of different crackability between the feed injected in the conventional nozzle and the feed injected in downstream nozzles, a fraction of feed B is injected with feed A in the base of the riser reactive section.

Results for case 9 are inferior to those of base case 8 where the feed is not segregated. Data are collected in Tables 4A and 4B below. In all cases the temperature was kept at 540° C. Thus, in spite of the effect of the temperature profile in the reaction zone, the improvement attained by the concept of segregation of feeds of different crackability may be lost when a portion of feed B contaminates feed A in the base of the riser reactive section.

TABLE 4A

| | Feed A | Feed B | | | | |
|---|---|---|---|---|---|---|
| Case | Riser Base " (%) | Riser Base (%) | 25% Riser (%) | 50% Riser (%) | Temp. (° C.) | Dispersion steam (%) |
| 8 | 75 | 25 | — | — | 220 | 10 |
| 9 | 75 | 10 | 15 | — | 220 | 10 |

TABLE 4B

| | | | Yields | | | | | |
|---|---|---|---|---|---|---|---|---|
| Case | CTO | Conv. (%) | FG (%) | LPG (%) | GLN (%) | LCO (%) | DO (%) | Coke (%) |
| 8 | 6.7 | 65.2 | 3.0 | 13.2 | 43.7 | 17.7 | 17.1 | 5.3 |
| 9 | 6.0 | 64.4 | 3.1 | 10.7 | 452 | 18.2 | 17.5 | 5.4 |

Wherein: CTO = Catalyst To Oil ratio"
FG = Fuel Gas
GLN = Gasoline
LCO = Light Cycle Oil
DO = Deasphalted Oil
LPG = Liquefied Petroleum Gas

Example 4

This Example illustrates that, contrary to state-of-the-art processes that teach improvements in octane rating of the produced gasoline, the present process yields a gasoline that does not necessarily undergo any change in octane rating, the most relevant parameters being kept practically constant. This behavior is illustrated in Table 5 below.

TABLE 5

| Case | % feed A base | % feed B base | % feed B 50% riser | MON | RON | $S_{naphtha}$ wt % | $S_{LCO}$ wt % | $S_{residuum}$ wt % |
|---|---|---|---|---|---|---|---|---|
| A | 85 | 15 | — | 80.49 | 96.87 | 0.33 | 1.24 | 1.52 |
| B | 85 | — | 15 | 80.60 | 96.90 | 0.39 | 1.28 | 1.03 |

Therefore, the outlined invention is basically distinct from what is taught in the open literature, since it suggests the segregated injection of a feed from a thermal or physical separation process that shows a higher contaminant content.

Besides, basing the difference between feeds on the nitrogen content or the change in the riser temperature profile only are not sufficient criteria so that a conversion rise can be observed.

Conversion rises to valuable products are observed as a result of a combination of conditions that include not only the difference in nitrogen content of the mixed feed but also a higher contaminant content, such as asphaltenes, aromatics, polynuclear compounds and nickel, as reflected in the density of the more refractory feed to cracking, but also the suitable atomization temperature of this feed as well as the dispersion degree of same.

Besides, it should be clear to the experts in the field that the versatility of the present cracking process makes that by varying the injection location of the more refractory feed throughout the riser length, it may be possible to alter as desired the light products profile directed to higher yields either in LPG or in gasoline.

We claim:

1. A process for the fluid catalytic cracking of mixed feedstocks of hydrocarbons from different sources, in a riser reactor and in the presence of a zeolitic catalyst, under cracking conditions for producing light products such as LPG, said mixed feedstocks comprising feeds A and B, with feed B being more refractory to cracking, wherein said process comprises simultaneous segregated injections of feeds A and B, in distinct riser locations, and includes the steps of:

a) injecting feed A at a location at the bottom of the riser reactor, which sets the base of the riser reactive section, with a temperature rise ranging from 10 to 50° C.; and b) injecting feed B, at an amount of from 5 to 50 wt % based on the total mixed feedstock, downstream, after maximum LPG production from feed A, at one or more riser locations between 10% and 80% of the riser reactive section;

wherein the injection conditions in a high dispersion degree of feed B comprise:

dispersion steam ranging from 5 to 20%; and a temperature equal to or higher than the injection temperature of feed A;

wherein the catalyst to oil ratio is maintained during the cracking of feeds A and B, and the light products resulting from the cracking process are recovered in a higher amount than would be obtained if feed B was injected in the base of the riser reactive section.

2. A process according to claim 1, wherein feed A is a heavy distillation gasoil (HVGO).

3. A process according to claim 1, wherein feed B is produced by a thermal or by a physical separation process.

4. A process according to claim 3, wherein feed B is produced by a pyrolysis, delayed coking and shale oil retorting process.

5. A process according to claim 1, wherein the injection riser location of feed B is between 25% and 50% of the riser reactive section.

6. A process according to claim 1, wherein the temperature rise in the mixing region between feed A and the regenerated catalyst is of from 10° C. to 50° C., provided by the injection of feed B in a riser location downstream of the injection location of feed A, and is in the range of from 520° C. to 650° C.

7. A process according to claim 1, wherein the riser outlet reaction temperature is in the range of from 520° C. to 590° C.

8. A process according to claim 1, wherein the flow of the reactive catalyst to oil mixture is upwards.

9. A process according to claim 1, wherein the flow of the reactive catalyst to oil mixture is downwards.

10. A process according to claim 1, wherein the catalyst comprises a Y zeolite.

11. A process according to claim 1, wherein the catalyst comprises a ZSM-5 zeolite.

12. A process according to claim 1, wherein the catalyst comprises a combination of Y and ZSM-5 zeolites in any amount.

13. A process according to claims 10, 11 or 12, wherein the zeolite catalysts comprise zeolites as additives.

* * * * *